United States Patent [19]

Ceike Shapiro

[11] Patent Number: 4,937,902

[45] Date of Patent: Jul. 3, 1990

[54] CRIB STRUCTURE WITH SLIDABLE STEPS PROVIDING STORAGE COMPARTMENTS

[76] Inventor: Kathy Ceike Shapiro, 3600 Embassy Dr., West Palm Beach, Fla. 33401

[21] Appl. No.: 437,988

[22] Filed: Nov. 16, 1989

Related U.S. Application Data

[62] Division of Ser. No. 207,299, Jun. 25, 1989, Pat. No. 4,882,799.

[51] Int. Cl.[5] ..... A47D 7/01

[52] U.S. Cl. ..... 5/93 R; 5/308; 5/507; 182/34; 182/88; 312/235.1

[58] Field of Search ..... 5/93 R, 507, 308, 58, 5/100; 312/235.1; 182/34, 35, 33.5, 88; D6/383, 384

[56] References Cited

U.S. PATENT DOCUMENTS

| | | | |
|---|---|---|---|
| D. 156,678 | 12/1949 | Stettner | D6/390 |
| 1,391,566 | 9/1921 | Musselman | 5/308 |
| 1,859,912 | 5/1932 | Brooker | 5/308 |
| 2,563,436 | 8/1951 | Totm | 312/235.1 |
| 2,682,671 | 7/1954 | Faure | 5/507 |
| 4,139,077 | 2/1979 | Pena, Jr. | 182/35 |
| 4,545,628 | 10/1985 | Richey | 312/235.1 |

*Primary Examiner*—Alexander Grosz
*Attorney, Agent, or Firm*—Steele, Gould & Fried

[57] ABSTRACT

A crib structure for a child includes a support surface for the child. A plurality of side walls are operatively connected to the support surface. At least one of the side walls includes a door opening and at least one door. The door is laterally slidable substantially in the direction to and from an adjacent side wall, such that the child can be quietly and easily placed into and taken the crib through the door opening without substantial bending or reaching. The sidewalls and the support surface define an interior space therebetween and an exterior space surrounding the sidewalls. At least one of the side walls is preferably composed of a material which is substantially flexible to forces directed substantially from the interior, and substantially rigid to forces directed substantially from the exterior. Step structure is preferably provided beneath the support surface. The step structure is movably mounted beneath the support surface and has a retracted position substantially beneath the support surface and an extended position laterally outward from and below the support surface. Lid structure is connected to the step structure whereby the step structure is adapted to function as a step, a drawer, or a seat.

3 Claims, 4 Drawing Sheets

CRIB STRUCTURE WITH SLIDABLE STEPS PROVIDING STORAGE COMPARTMENTS

CROSS REFERENCE TO RELATED APPLICATION

This is a division of application SN 207,299, filed June 25, 1988, now U.S. Pat. No. 4,882,799.

1. Field of the Invention

This invention relates generally to bedding, and more particularly to cribs for children.

2. Description of the Prior Art

There are a number of variations on the design of cribs for children. Many inventions have been directed to the construction of crib structures which are convenient to use. Other crib structures have been directed to combinations of cribs with other articles such as dressing tables and chests of drawers. There remains a need for improved crib structures which facilitate the care of an infant.

SUMMARY OF THE INVENTION

It is an object of the invention to provide a crib structure which will permit a child to be placed into and taken from the crib without substantial bending or reaching.

It is another object of the invention to provide a crib structure which will permit an older infant to enter and leave the crib without assistance.

It is still another object of the invention to provide a crib with structure to permit a parent to sit next to the child.

It is yet another object of the invention to provide a crib with storage space for articles.

It is still another object of the invention to provide a crib with structure for accessing the crib that will be quietly movable and easily slidable so that the crib can be accessed without awakeninq the baby.

These and other objects are accomplished by a crib for a child comprising a support surface for the child. A plurality of side walls are operatively connected to the support surface. At least one of the side walls preferably comprises a door opening and has at least one door means adapted to close the door opening. The door means is laterally slidable substantially in the direction to and from an adjacent side wall. The child can be placed into and taken from the crib through the door opening without substantial bending or reaching.

The door means preferably comprises two laterally adjacent doors. Each door is adapted for sliding laterally substantially in the direction of a most adjacent side wall.

Track means are preferably provided. The track means preferably span substantially the width of the door opening. The track means are adapted to slidably engage the door means and to direct the door means laterally to and from an adjacent side wall.

First track means are preferably provided substantially adjacent the support surface. Second track means can be substantially parallel to the first track means and above the support surface. The door means can be slidably engaged between the first and second track means.

Side walls adjacent to the side wall comprising the door opening can comprise pockets. The track means extend into the pockets, such that the door means can be moved along the track means into the pockets.

The door means preferably comprise panels and door posts. The door posts are slidably engaged between the track means and the panels are fixed to the door posts.

The panels are preferably flexible. The panels most preferably are substantially flexible when subjected to a force directed from one direction, and are substantially rigid when subjected to a force directed substantially in an opposite direction. The panels can comprise a plurality of substantially parallel slats having an outside surface, an inside surface, and two side surfaces. The slats are fastened together substantially at the rear surface by fastening means. The fastening means preferably comprise a flexible backing. The rear surface of the slats are joined to the flexible backing by suitable attachment means such as an adhesive. The side surfaces are preferably bevelled inwardly from the front surface to the rear surface.

A multi-sided crib according to the invention comprises a support surface and a plurality of upstanding sidewalls fastened to the support surface, defining an interior space between the upstanding side walls and above the support surface, and an exterior space surrounding the side walls. At least one of the side walls comprises at least a portion that is substantially flexible to forces directed substantially from the interior space, and substantially rigid to forces directed substantially from the exterior space, whereby an infant can bump against the interior of a side wall and the blow will be cushioned by the flexible nature of the sidewall, and forces directed substantially from the exterior space toward the child will be blocked.

The side walls preferably comprise panels with plurality of slats aligned in an adjacent relationship and having an outside surface, an inside surface, and two side surfaces. The slats are fastened together substantially at the rear surface. The side surfaces preferably are bevelled inwardly from the front surface to the rear surface.

The crib preferably comprises a door opening in at least one of the side walls and at least one door means moveable between an open position and a closed position in the door opening. The door means is preferably laterally slidable substantially in the direction to and from an adjacent side wall. Track means can be provided in the door opening. The door means is slidably engaged to the track means whereby the track means will direct the door means to and from an adjacent side wall.

A crib according to the invention preferably comprises a support surface and a number of upstanding walls. Moveable step structure is provided and has a retracted position substantially beneath the support surface and an extended position laterally outward from and beneath the support surface. The step structure preferably comprises lid structure whereby the step structure is adapted to function as steps, as a seat for the parent, and as a space for the storage of articles.

The step structure is preferably formed in a staggered orientation of two or more steps. The steps allow the child to enter and leave the crib, and also provide a seat for the parent alongside the support surface.

The steps preferably comprise structure for slidably mounting the steps beneath the support surface. The structure preferably comprises a wheel and track engagement structure, in which either of a wheel and a track are mounted to the steps and to a portion of the remaining crib structure to permit sliding movement of the steps.

BRIEF DESCRIPTION OF THE DRAWINGS

There are shown in the drawings embodiments which are presently preferred it being understood, however, that the invention is not limited to the precise arrangements and instrumentalities shown, wherein.

DETAILED DESCRIPTION OF THE PREFERRED EMBODIMENTS

Figure 2:
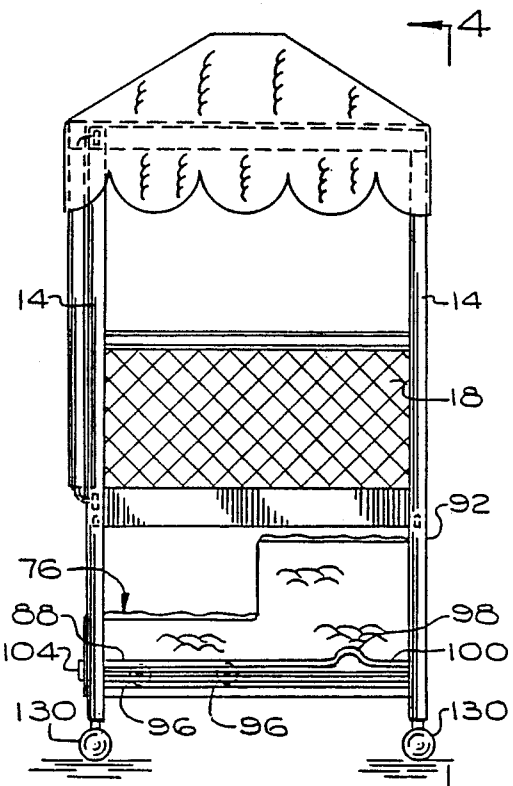
FIG. 2 is a side elevation.
Figure 1:
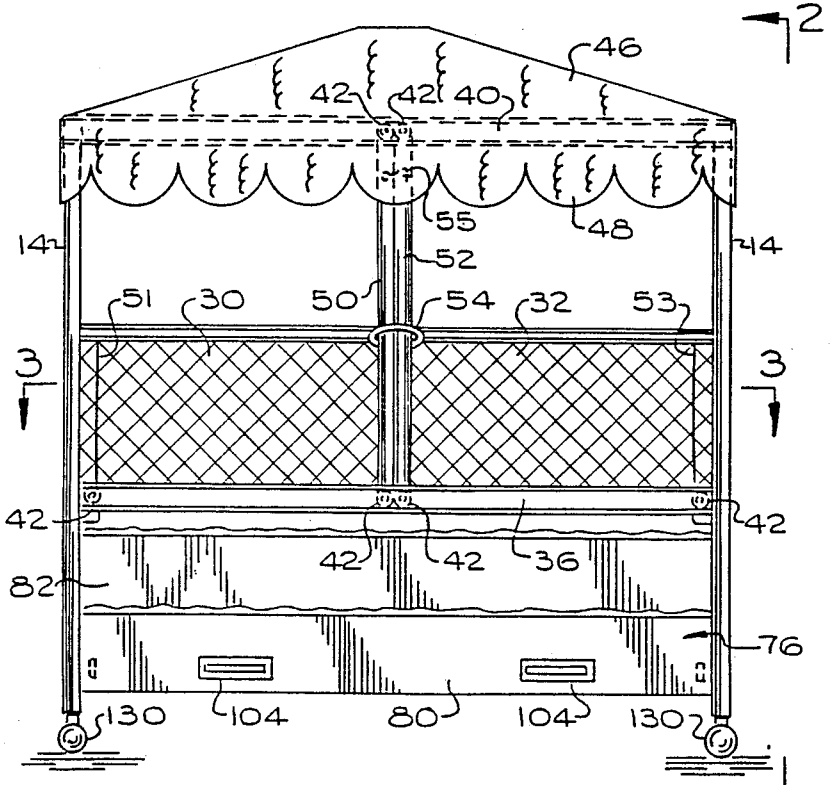
FIG. 1 is a front elevation of a crib according to the invention.
Figure 3:
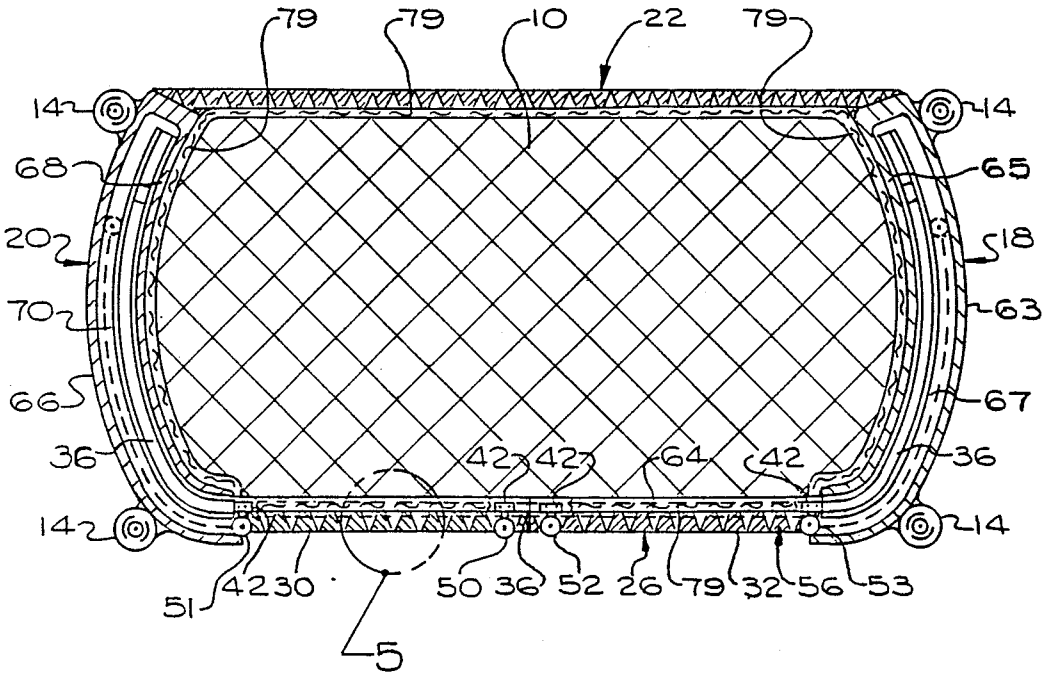
FIG. 3 is a cross-section taken along line 3—3 in FIG. 1.
Figure 4:
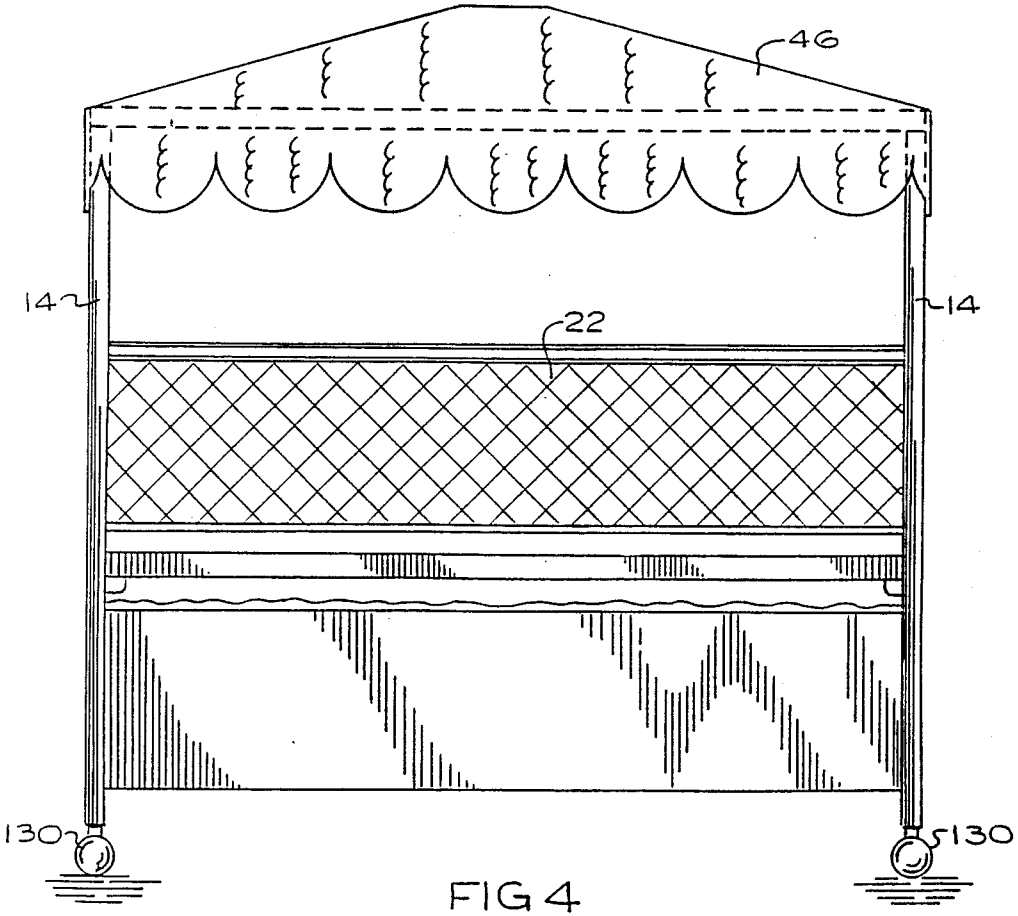
FIG. 4 is a rear elevation.
Figure 8:
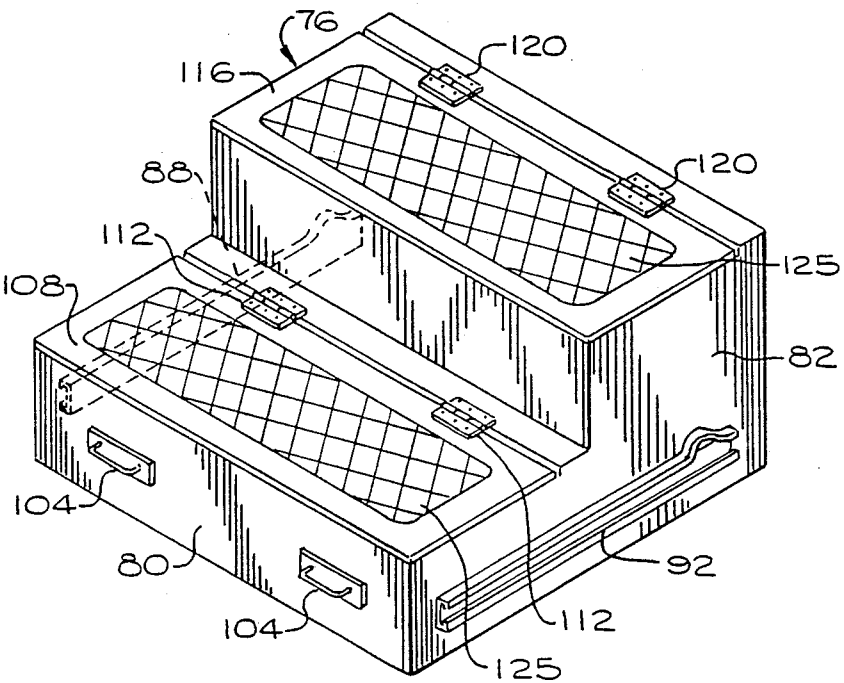
FIG. 8 is a perspective view of step structure.

Referring to FIGS. 1–4, there is shown a preferred embodiment of a crib according to the invention. The crib includes a support surface 10. The support surface 10 can be supported above the ground by suitable structure such as the crib posts 14. The crib posts 14 are operatively connected to the support surface preferably at opposing corners thereof as shown. The support surface 10 can be fashioned from any suitable rigid or semi-rigid material capable of supporting the weight of the child. The support surface 10 can itself be padded, or can be used to support a mattress or the like. A number of side walls are operatively connected to the support surface 10 and preferably are fixed in an upstanding relation to the support surface 10. The side walls can include a head side wall 18 and a foot side wall 20. A rear side wall 22 and a front side wall 26 are also provided. The upstanding side walls 18, 20, 22, and 26 substantially encircle the support surface 10 and define an interior space between the side walls and above the support surface, and an exterior space surrounding the side walls and the interior space.

The front side wall 26 preferably includes at least one door opening which can be closed by at least one door. Two doors preferably are provided, as the doors 30 and 32. The doors 30 and 32 preferably are laterally slidable substantially in the direction to and from adjacent side walls, as the head side wall 18 and the foot side wall 20. The door 30 therefore is preferably adapted for sliding to and from the foot sidewall 20, while the door 32 is adapted for sliding to and from the head sidewall 18. A child can be quietly and easily placed into and taken from the crib through the door opening without substantial bending or reaching in opening and closing the door.

Track means are preferably provided and substantially span the door opening. The track means are adapted to slidably engage the door means and to direct the door means laterally to and from the adjacent side walls. A first track means 36 is preferably provided substantially adjacent to the support surface 10. A second track means 40 (phantom lines in FIG. 1) is provided substantially above the support surface and substantially parallel to the track means. The door means is preferably slidably engaged between the first track means 36 and the second track means 40. Wheels 42 or the like on the doors 30 and 32 can slidably engage the track means to permit lateral movement of the door and prevent removal. The track means can be of any suitable structure, and can be substantially squared-off, C-shaped in cross-section to receive the wheels 42.

The second track 40 can be fixed to topmost ends of the crib posts 14, where a canopy 46 can also be provided. The canopy 46 can be fixed to the crib posts 14 and an apron 48 of the canopy can extend over the track 40 to provide a more attractive appearance.

It is desirable that the doors 30, 32 not extend to the second track 40 and the canopy 46 so that the parent can easily lean over the top of each door to view the infant. Door posts 50, 51, 52 and 53 can be secured to the doors 30 and 32, respectively. The door posts 50 and 52 have a wheel 42 secured thereto at each end that is slidably engaged to the first track means 36 and the second track means 40. The door posts 51 and 53 are secured only to the first track means 36, as these posts preferably do not extend to the second track means 40. The door posts 50, 51, 52 and 53 can be of any suitable construction, but preferably comprise a rigid core such as wood dowels or the like surrounded by a padded material such as a synthetic foam. Fastening means such as the upper hook means 54 and the lower hook means 55 can be provided to secure the doors 30, 32 together in the closed position to prevent accidental opening. The upper hook means 54 allow the parent to quietly and easily unlatch and open the door without bending or reaching.

Figure 5:
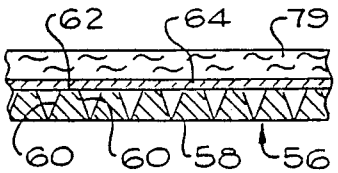
FIG. 5 is a enlarged view of a portion of FIG. 3.

The doors 30, 32 preferably comprise materials which are flexible to permit the doors to bend at the head side wall 18 and the foot side wall 20 for convenient storage when in the open position. A preferable flexible material is shown in FIG. 5. The material comprises a series of slats 56 that are arranged in an adjacent relationship. The slats 56 include a front face 58, side faces 60, and a rear face 62. Adjacent slats are fastened together substantially at the rear face 62. This can be accomplished by fastening the rear faces 62 to a flexible backing 64. The flexible backing 64 can be of any suitable material with the characteristics of flexibility and strength. Synthetic fabrics are especially suitable. The side faces 60 are preferably bevelled inwardly from the front face 58 to the rear face 62.

Figure 6:
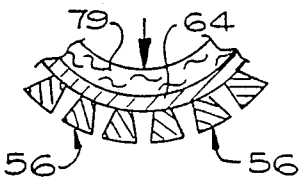
FIG. 6 is the view of FIG. 5 in an alternative mode of operation.

The side wall material of the invention is flexible when subjected to forces directed from the interior space of the crib as shown in FIG. 6. The force is applied in the direction of the arrow from the interior space of the crib. The flexible backing 64 gives way and the slats 56 separate as shown such that the material flexes under the applied force. The bevelled faces 60 permit the slats 56 to easily separate from one another as the backing 64 flexes. The infant may fall against the side wall and the flexing of the side wall material will cushion the blow. A flexible rail or cap 59 can line upper edge surfaces such as the upper edge of the doors 30, 32. The flexible rail 59 will bend with the doors 30, 32 at the head sidewall 18 and the foot sidewall 20.

Figure 7:
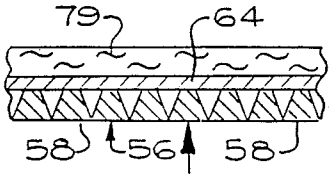
FIG. 7 is the view of FIG. 5 in yet another mode of operation.

The side wall material of the invention will be flexible in response to blows by the infant within the crib, yet also rigid to blows directed from the exterior, as when an object inadvertently falls against the crib. Such an exterior blow is shown in FIG. 7, where the arrow indicates an applied force from the exterior of the crib. The adjacent slats 56 rigidly bind together as the front faces 58 of the slats are thrust toward on another under the flexing action of the applied force. The material will then be substantially rigid in response to forces applied from the exterior of the crib and will protect the child from minor blows.

The head side wall 18 and foot side wall 20 are preferably provided with pockets to receive the doors 30, 32, respectively. The head side wall 18 can comprise an outer face 63 and an inner face 65 which define an open interior pocket 67. The pocket 67 is adapted to receive the door 32 when the door 32 is moved laterally toward the head side wall 18 (phantom lines in FIG. 3). Similarly, the foot side wall 20 can comprise an outer face 66 and an inner face 68 to define a pocket 70. The door 30 can travel into the pocket 70 when the door 30 is moved laterally toward the foot side wall 20 (phantom lines in FIG. 3). The track 36 extends into the pockets 67 and 70 to facilitate movement of the doors 30 and 32 into the pockets. The door posts 51 and 53 are preferably dimensioned to permit sliding into the enclosed pockets 67 and 70, although the posts 51 and 53 could extend to the second track 40 if the pockets 67 and 70 opened upwardly.

It is desirable to orient the slats vertically in the doors 30, 32. A vertical orientation will permit the doors to gather and bend with respect to one another at the head side wall 18 and foot side wall 20 when the doors 30, 32 are moved laterally. A substantially horizontal orientation of the slats 56 would resist flexing at the head side wall 18 and foot side wall 20 and therefore the doors 30, 32 could not conveniently be opened without extending the doors beyond the head side wall 18 and foot side wall 20.

Pull-out steps can be provided beneath the support surface to permit the child to enter or leave the crib and to provide seating for a parent adjacent to the child. Step structure 76 is preferably mounted beneath the support surface 10 and has an extended position laterally outward from and below the support surface 10 and a retracted position substantially directly beneath the support surface 10. The step structure 76 is preferably formed as a pair of steps 80 and 82, although more steps could be provided if desired.

The step structure 76 preferably is slidably mounted beneath the support surface 10. A preferable mounting structure comprises cooperating wheel and track structure. Track structure 88 and 92 can be provided on opposing sides of the step structure 76. The track structure 88 and 92 is adapted to engage wheels 96 rotatably mounted to the crib structure as on a support 100. Handles 104 can be provided for grasping the step structure 76. The step structure 76 can thereby be moved from the retracted position beneath the support surface 10 to the extended position laterally adjacent from and below the support surface 10 simply by pulling the step structure 76, as by handles 104. A half circular stop 98 can be provided in each of the tracks 88 and 92 to engage the wheels 96 and to thereby secure the step structure 76 in the extended position.

The steps 80 and 82 can be fashioned so as to be hollow and preferably include lid structure 108 and 116, respectively, so that the steps can conveniently be used to store articles. Pull out drawers would alternatively be possible. The lid 108 can be hingably mounted to the step 80 as by hinges 112. The lid 116 can be hingably mounted to the step 82 as by hinges 120. Articles can then be conveniently stored with the crib.

Additional features may be provided to improve the utility of the crib. Padding 79 can line all interior surfaces of the crib. The steps 80 and 82 can have padded surfaces 125 to provide extra comfort for the parent when the steps are used as a seat. Casters 130 can be provided on lower ends of the crib posts 14 to facilitate movement to the crib.

This invention can be provided in other forms without departing from the spirit or essential attributes thereof and accordingly, reference should be made to the following claims, rather than to the foregoing specification, as indicating the scope of the invention.

I claim:

1. A crib comprising:

a support surface;

upstanding side walls substantially enclosing said support surface;

a base structure adapted to retain said support surface above a floor;

a movable step structure mounted beneath said support surface, said step structure comprising at least two steps having a retracted position substantially beneath the support surface, and an extended position laterally outward from and below the support surface; said steps being laterally and vertically offset from each other at least in the extended position;

at least one of said steps having at least one storage compartment and closure structure, for accessing the storage compartment, whereby a child can enter and leave the crib using said steps, and said steps can be used as a seat by a parent and as a storage compartment.

2. The crib of claim 1, wherein said steps are mounted beneath the support surface by cooperating wheel and track structure.

3. The crib of claim 1, wherein said closure structure comprises a padded lid.

* * * * *